US008854153B2

(12) United States Patent
Kauffman

(10) Patent No.: US 8,854,153 B2
(45) Date of Patent: Oct. 7, 2014

(54) DEVICE FOR TRANSMITTING ELECTROMAGNETIC SIGNALS

(76) Inventor: George M. Kauffman, Hudson, MA (US)

( * ) Notice: Subject to any disclaimer, the term of this patent is extended or adjusted under 35 U.S.C. 154(b) by 565 days.

(21) Appl. No.: 13/135,331

(22) Filed: Jul. 1, 2011

(65) Prior Publication Data

US 2012/0000706 A1 Jan. 5, 2012

Related U.S. Application Data

(60) Provisional application No. 61/398,936, filed on Jul. 2, 2010.

(51) Int. Cl.
*H01P 1/202* (2006.01)
*H01P 3/06* (2006.01)

(52) U.S. Cl.
CPC . *H01P 1/202* (2013.01); *H01P 3/06* (2013.01)
USPC ..... 333/100; 333/136; 333/132; 333/22 R

(58) Field of Classification Search
USPC ..... 333/100, 121, 124, 115, 109, 127, 22 R
See application file for complete search history.

(56) References Cited

U.S. PATENT DOCUMENTS 3,048,780 A * 8/1962 Diambra et al. ..... 725/14
3,970,969 A * 7/1976 Sirel et al. ..... 333/12
4,161,704 A * 7/1979 Schafer ..... 333/33
4,554,608 A * 11/1985 Block ..... 361/119
5,764,114 A * 6/1998 Kuhne ..... 333/12
6,101,080 A * 8/2000 Kuhne ..... 361/119
7,453,352 B2 * 11/2008 Kline ..... 370/463
2004/0169986 A1 * 9/2004 Kauffman ..... 361/119

OTHER PUBLICATIONS

Microwaves101.com, www.microwaves101.com/encyclopedia/coax.cfm, Coax, Updated Aug. 29, 2008, Jan. 24, 2010 archive date from archive.org, retrieved Dec. 9, 2013. Coax Overview section and Characteristic Impedance Section.*

* cited by examiner

*Primary Examiner* — Stephen Jones
*Assistant Examiner* — Scott S Outten
(74) *Attorney, Agent, or Firm* — Kriegsman & Kriegsman

(57) ABSTRACT

An RF transmission line device with high performance, wide band characteristics includes an inner conductor for transmitting communication signals of a desired frequency band and a grounded outer conductor electrically insulated from the inner conductor by at least one dielectric material. A tap conductor is connected to the inner conductor and serves as an auxiliary path through which signals outside the desired frequency band can be externally injected into and/or retrieved from the through RF path, the tap conductor extending longitudinally through a tap housing conductively coupled to the outer conductor. As a feature of the invention, a modular attachment is removably coupled to the tap housing and includes a plurality of voltage suppression components that are arranged in the conductive path between the tap conductor and the tap housing, the voltage suppression components discharging transient voltages diverted from the inner conductor by the tap conductor.

25 Claims, 11 Drawing Sheets

DEVICE FOR TRANSMITTING ELECTROMAGNETIC SIGNALS

CROSS-REFERENCE TO RELATED APPLICATIONS

The present application claims the benefit of U.S. Provisional Patent Application Ser. No. 61/398,936, which was filed on Jul. 2, 2010 in the name of George M. Kauffman, the disclosure of which is incorporated herein by reference.

BACKGROUND OF THE INVENTION

The present invention relates generally to devices for transmitting electromagnetic signals of a desired frequency range and more particularly to devices for transmitting electromagnetic signals of a desired frequency range that additionally provide both over-voltage protection to the transmission line and signal filtering capabilities.

A radio frequency (RF) transmission line is a structure that is designed to efficiently transmit high frequency radio frequency (RF) signals. An RF transmission line typically comprises two conductors, such as a pair of metal wires, that are separated by an insulating material with dielectric properties, such as a polymer or air. One type of an RF transmission line which is well known in the art is a coaxial electric device.

Coaxial electric devices, such as coaxial cables, coaxial connectors and coaxial switches, are well known in the art and are widely used to transmit electromagnetic signals over 10 MHz with minimum loss and little or no distortion. As a result, coaxial electric devices are commonly used to transmit and receive signals used in telecommunications, broadcast, military, security and civilian transceiver applications as well as numerous other uses.

A coaxial electric device typically comprises an inner signal conductor which serves to transmit the desired high frequency communication signal between a source and a load. The inner signal conductor is separated from an outer conductor by an insulating material, or dielectric material, the outer conductor serving as the return path, or ground, for the communication signal. Such an electric device is typically referred to as coaxial because the inner and outer conductors share a common longitudinal axis. It should be noted that the relationship of the geometry of the conductors and the properties of the dielectric materials disposed between the conductors substantially define the characteristic impedance of the coaxial device.

It has been found that, on occasion, potentially harmful voltages are transmitted through RF transmission lines. In particular, radios operating in either the lower end of the ultra high frequency (UHF) band or lower frequency bands (i.e., below 500 MHz) often utilize longer antenna lengths to enhance performance when compared to antennae used in higher frequency applications. In addition, the long range signal propagation characteristics of these lower frequencies allow for superior long range communication. Furthermore, since the mounting height of a radio antenna serves to increase its range, radio antennae are commonly mounted from an elevated position (e.g., a tower or mast). As a result, it has been found that radio antennae are highly susceptible to lightning strikes, the high electrical energy of a lightning strike increasing the likelihood of significant damage to any sensitive components connected to the transmission line, which is highly undesirable.

As a result, at least one RF transmission line component is commonly provided with a protective device for suppressing or otherwise deflecting undesirable electromagnetic impulses away from a load connected thereto. For example, it is well known in the art for a coaxial electric device to include a shunt conductor that connects the inner conductor either to a high voltage suppression device, such as one or more gas discharge tubes, or directly to a grounded element, such as the outer conductor. Accordingly, in use, the shunt conductor serves to divert potentially harmful transient voltages away from the transmission line for suppression and/or grounding, which is highly desirable. An example of a protective device provided with a shunt conductor for diverting undesirable impulses away from an RF transmission line is shown in U.S. Pat. No. 7,440,253 to George M. Kauffman, the disclosure of which is incorporated herein by reference.

Electrical devices of the type as described above are also often provided with at least one filtering device for separating from the input signal, inter alia, (i) lower frequency signals (i.e., signals that fall beneath the desired high frequency band) which can ultimately be used as control and/or modem signals, and/or (ii) power (e.g., direct current (DC) power) that can be used to power remote end devices.

Although well known in the art, electrical devices of the type as described above that include protective and/or filtering components typically suffer from at least some of following shortcomings.

As a first shortcoming, electrical devices of the type as described above traditionally include protective and/or filtering devices that are installed in a relatively inaccessible manner. Accordingly, if either the protective or filtering device needs to be accessed over time for replacement or repair (e.g., after a lightning strike), a significant degree of disassembly (and subsequent reassembly) is typically required. Due to the labor-intensive nature of such an action, electrical devices with old or defective components are often discarded and replaced in their entirety, which is highly undesirable from a cost perspective.

As a second shortcoming, electrical devices of the type as described above are typically designed and manufactured with a pre-defined, unmodifiable set of performance capabilities. As a result, traditional electrical devices can not be readily enhanced, or otherwise modified, by the user to acquire additional capabilities. For example, a traditional electrical device that is constructed with high voltage suppression capabilities can not be easily modified by the user to additionally acquire signal filtering capabilities.

SUMMARY OF THE INVENTION

It is an object of the present invention to provide a new and improved device for transmitting electromagnetic signals of a desired frequency band from a source to a load.

It is another object of the present invention to provide a new and improved device as described above that is designed to provide an exceptionally wide band RF through path from the source to the load.

It is yet another object of the present invention to provide a device as described above which is provided with at least one protective component for diverting transient, high voltage signals received from the source that exceed a predefined threshold away from the load.

It is still another object of the present invention to provide a device as described above which is provided with at least one filtering component for separating from the signal received by the source (i) direct current (DC) power and/or (ii) selected electromagnetic signals that fall beneath the desired frequency band.

It is yet still another object of the present invention to provide a device as described above which is designed to facilitate the replacement and/or repair of selected protective and filtering components.

It is another object of the present invention to provide a device as described above which has readily modifiable protective and filtering capabilities.

It is yet another object of the present invention to provide a device as described above which is limited in size, includes a limited number of parts, is inexpensive to manufacture and is easy to assemble.

Accordingly, as one feature of the present invention, there is provided a device for transmitting electromagnetic signals of a desired frequency band, the device comprising (a) an outer conductor, (b) an inner conductor extending within the outer conductor, the inner and outer conductors being spaced apart and electrically insulated from one another, (c) a tap conductor for diverting transient voltages away from the inner conductor that fall outside the desired frequency band, the tap conductor comprising a first end and a second end, the first end of the tap conductor being conductively coupled to the inner conductor, the tap conductor being insulated from the outer conductor, and (d) a modular attachment mechanically and conductively coupled to the outer conductor, the attachment comprising a plurality of voltage suppression components for discharging transient voltages diverted by the tap conductor, each of the plurality of voltage suppression components being conductively coupled to the tap conductor and the outer conductor.

As another feature of the present invention, there is provided a combination adapted to be mounted into in a hole in a conductive housing, the combination comprising (a) a connector, the connector comprising, (i) a conductive outer shell, and (ii) a conductive center pin extending within the outer shell, the center pin being insulated from the conductive outer shell, and (b) a filter, the filter comprising, (i) a foil member conductively coupled to the center pin, and (ii) a pair of dielectric washers disposed on opposite surfaces of the foil member, (c) wherein the conductive outer shell and the pair of dielectric washers are adapted to be fittingly inserted into the hole in the conductive housing, the pair of dielectric washers insulating the foil member from both the outer shell of the auxiliary connector and the conductive housing so as to establish a capacitance therebetween.

As still another feature of the present invention, there is provided an RF transmission line device for transmitting electromagnetic signals of a desired frequency band, the RF transmission line device having a nominal characteristic impedance, the RF transmission line device comprising (a) a grounded outer conductor, (b) an inner conductor extending within the outer conductor, the inner and outer conductors being electrically insulated from one another, and (c) a tap conductor for diverting transient voltages away from the inner conductor that fall outside the desired frequency band, the tap conductor comprising a first end and a second end, the first end of the tap conductor being conductively coupled to the inner conductor, (d) wherein the tap conductor functions as a quarter wave stub, the quarter wave stub being dually compensated through the creation of an inner pair of identical, below nominal quarter wavelength impedances formed about the tap conductor and an outer pair of identical, below nominal quarter wavelength impedances formed about the tap conductor.

As yet still another feature of the present invention, there is provided a modular attachment adapted to be removably secured to an RF transmission line device, the RF transmission line device comprising an outer conductor, an inner conductor extending within the outer conductor, the inner and outer conductors being spaced apart and electrically insulated from one another, and a tap conductor for diverting transient voltages away from the inner conductor that fall outside the desired frequency band, the tap conductor comprising a first end and a second end, the first end of the tap conductor being conductively coupled to the inner conductor, the tap conductor being insulated from the outer conductor, the modular attachment comprising (a) a conductive end cap adapted to be conductively coupled to the outer conductor, (b) a metal contact spaced apart from the conductive end cap, the metal contact adapted to be conductively coupled to the tap conductor, (c) an insulator coupled to the conductive end cap and the metal contact, together the end cap, the contact and the insulator defining a cavity, and (d) a plurality of voltage suppression components disposed within the cavity for discharging transient voltages diverted by the tap conductor, each of the plurality of voltage suppression components being conductively coupled to the conductive end cap and the metal contact.

As another feature of the present invention, there is provided the combination of (a) an RF transmission line device, the RF transmission line device comprising an outer conductor, an inner conductor extending within the outer conductor, the inner and outer conductors being spaced apart and electrically insulated from one another, and a tap conductor for diverting voltages away from the inner conductor that fall outside the desired frequency band, the tap conductor comprising a first end and a second end, the first end of the tap conductor being conductively coupled to the inner conductor, the tap conductor being insulated from the outer conductor, and (b) an apparatus adapted to be coupled to the protective device, the apparatus comprising (i) a housing, (ii) a circuit disposed within the housing that is electrically coupled to the tap conductor, the circuit comprising a communication signal path that includes a modem, and (iii) a communication connector externally mounted on the housing in electrical connection with circuit.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration various embodiments for practicing the invention. The embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. In the drawings wherein like reference numerals represent like parts:

FIG. 3(*b*) is an enlarged section view of the protective and filtering attachment shown in FIG. 3(*a*), taken along lines 3B-3B;

DETAILED DESCRIPTION OF A PREFERRED EMBODIMENT

RF Transmission Line Device 11

Figure 1:
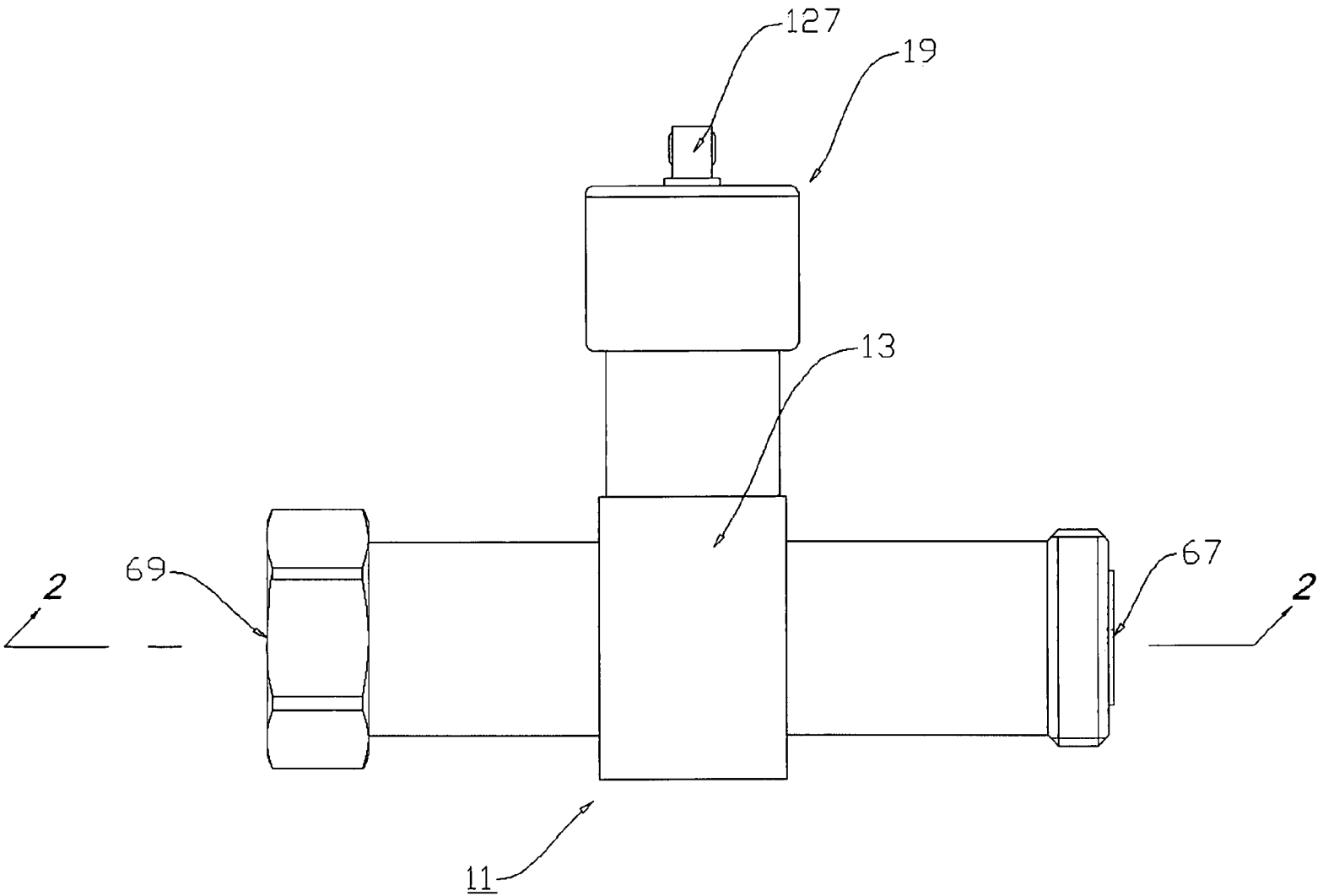
FIG. 1 is a front view of a first embodiment of a device for transmitting electromagnetic signals of a desired frequency band from a source to a load, the device being constructed according to the teachings of the present invention.
Figure 2:
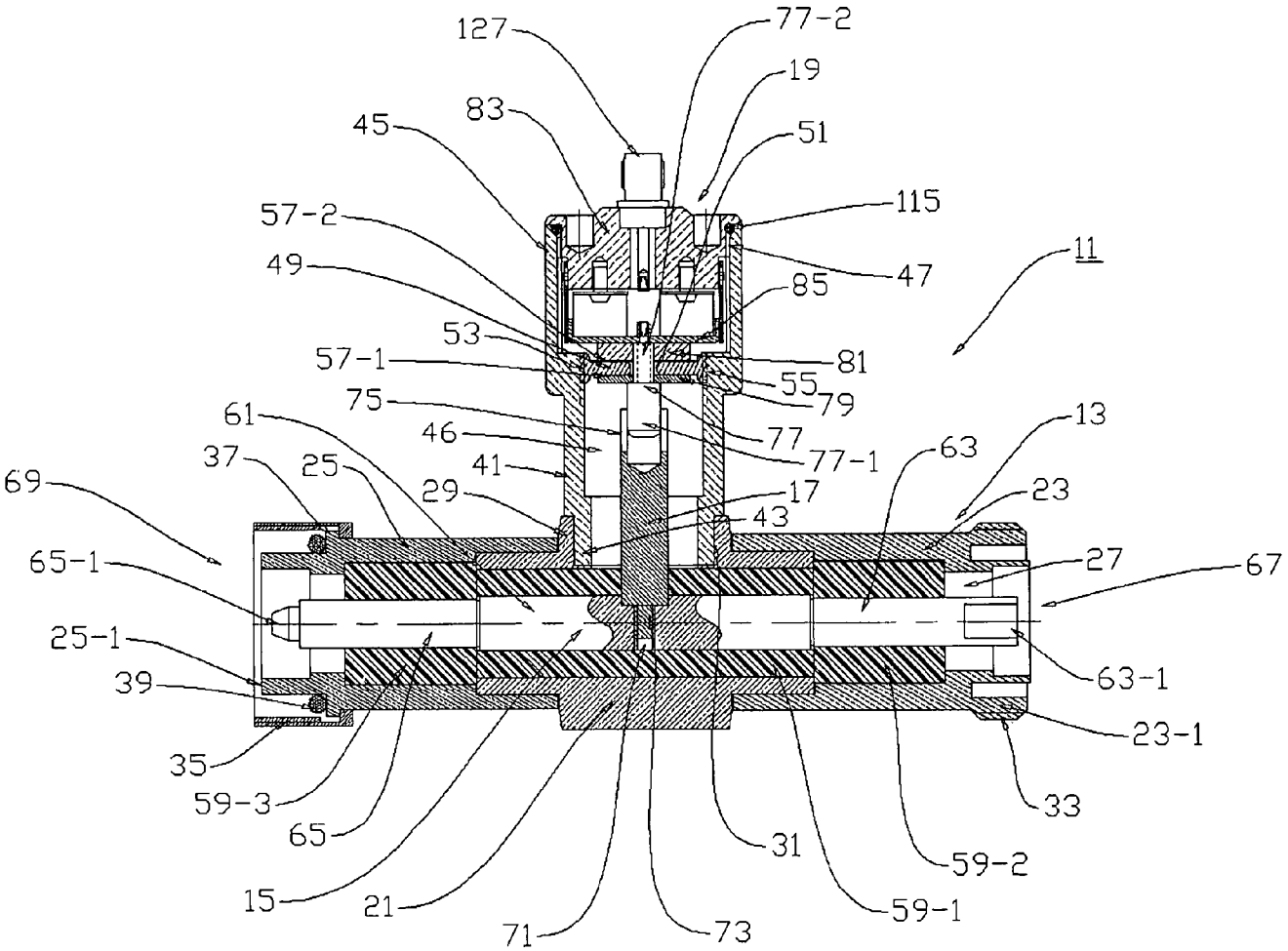
FIG. 2 is a section view of the device shown in FIG. 1, taken along lines 2-2.

Referring now to FIGS. 1 and 2, there are shown front and section views, respectively, of a first embodiment of a device for a radio frequency (RF) transmission line that is designed to transmit electromagnetic signals of a desired frequency band between a source and a load, the device being constructed according to the teachings of the present invention and represented generally by reference numeral 11.

Device 11 comprises an outer conductor 13, an inner conductor 15 extending within outer conductor 13, a tap conductor 17 conductively coupled to inner conductor 15 for diverting selected voltages and signals carried by inner conductor 15, and a modular protective and filtering attachment 19 removably coupled to outer conductor 13 and tap conductor 17. As will be described further in detail below, attachment 19 preferably includes (i) at least one voltage suppression component for discharging potentially harmful transient voltages diverted from inner conductor 15 by tap conductor 17 and (ii) at least one filtering component for separating power and low frequency communication signals that are either injected into or retrieved from inner conductor 15. Due to its modular, removable construction, attachment 19 is appropriately designed to replaced and/or repaired, as needed, to renew or modify the functional capabilities of device 11, which is a principal feature of the present invention.

Outer Conductor 13

Device 11 comprises an outer conductor 13 that serves as the return path, or ground, for the communication signal. Preferably, outer conductor 13 is cast, forged or otherwise constructed from a rigid, durable and highly conductive material, such as a copper alloy with a suitable conductive finish.

As seen most clearly in FIG. 2, outer conductor 13 comprises an intermediary, or center, section 21, a first end section 23 telescopingly mounted over one end of intermediary section 21 and a second end section 25 telescopingly mounted over the other end of intermediary section 21, sections 21, 23 and 25 being joined together through a press-fit relationship or any other suitable combination of conventional coupling techniques, such as fusion, solder or threadings. Together, sections 21, 23 and 25 provide outer conductor 13 with an enlarged, elongated, generally tubular design that is hollowed out along its length so as to define a partially enclosed, longitudinally extending, central cavity 27.

It should be noted that the inner, or through, diameter of center section 21 is slightly less than the common inner, or through, diameter of the proximal end of sections 23 and 25. As will be described further in detail below, the reduced inner diameter of intermediary section 21 of outer conductor 13 is used, in combination with additional structural features, to provide device 11 with high performance wide band capabilities.

Intermediary section 21 includes a boss 29 that is radially formed into its outer surface. Boss 29 is shaped to define a bore 31 that is generally circular in transverse cross-section and that extends in communication with central cavity 27. As will be described further below, bore 31 serves as an access port through which, inter alia, (i) potentially harmful electrical energy transmitted by inner conductor 15 can be diverted and discharged and (ii) power and/or low frequency communication signals can be injected into or retrieved from inner conductor 15.

The distal end 23-1 of first end section 23 is represented herein as being in the form of an industry-standard female connector end with external threads 33 integrally formed on its outer surface. Similarly, the distal end 25-1 of second end section 25 is represented herein as being in the form of an industry-standard male connector end that is designed for connection with a mating connector similar to that shown at the free end of first end section 23. As can be seen, a coupling nut 35 with a threaded inner surface is slidably mounted onto the distal end of second end section 25 and is held in place by an integrally formed, annular protrusion, or ring, 37. Furthermore, a rubber gasket, or O-ring, 39 is preferably positioned between second end section 25 and coupling nut 35 to create an adequate force and water seal between second end section 25 and a mating connector attached thereto.

However, it should be noted that the distal ends 23-1 and 25-1 are not limited to the aforementioned connector types. Rather, it is to be understood that distal ends 23-1 and 25-1 of first and second end sections 23 and 25, respectively, could be configured as alternative RF transmission line interfaces, such as direct cable attachment or launchers to printed circuit board traces, without departing from the spirit of the present invention.

Outer conductor 13 additionally includes a generally cylindrical tap housing, or extension, 41 that extends orthogonally out from center section 21. Tap housing 41 includes a narrow first end 43 and a widened second end 45 and is hollowed out along its length so as to define an auxiliary cavity 46. As can be seen, auxiliary cavity 46 extends generally at a right angle relative to central cavity 27 and is in communication therewith.

It should be noted that outer conductor 13 is not limited to the four-piece construction described herein (i.e., section 21, section 23, section 25 and tap housing 41). Rather, it is to be understood that outer conductor 13 could be alternatively formed from a greater or fewer number of separable components without departing from the spirit of the present invention.

It should also be noted that tap housing 41 need not extend at a right angle relative to center section 21. Rather, it is to be understood that tap housing 41 could be alternatively configured (e.g., as an annular member that wraps around center section 21 or as a member extending in co-axial alignment therewith) without departing from the spirit of the present invention.

Narrow first end 43 of extension 41 is preferably fittingly inserted into boss 29 through a press-fit relationship that is secure (i.e., permanent) in nature. As a result, outer conductor 13 is rendered a unitary item when in its assembled form.

Widened, or enlarged, second end 45 is provided with internal threads 47 that assist in the removable mechanical coupling of attachment 19 to outer conductor 13, as will be described further below.

A metallic ground disc 49 is disposed within auxiliary cavity 46 and is mechanically and conductively coupled to tap housing 41 between first and second ends 43 and 45. As can be seen, ground disc 49 has a substantially flat center region and includes a center hole 51 that is generally circular in transverse cross-section. Ground disc 49 additionally includes an external threading 53 about its periphery that engages a complementary threading 55 formed into the interior surface of tap housing 41. Accordingly, with ground disc 49 installed in tap housing 41, ground disc 49 effectively creates a substantially enclosed transverse wall within auxiliary cavity 46.

It should be noted that metallic ground disc 49 is not limited to threaded engagement with tap housing 41. Rather, it is to be understood that ground disc 49 could be coupled to tap housing 41 by alternative means, such as through a press fit, without departing from the spirit of the present invention. In fact, it is to be understood that tap housing 41 could be machined to integrally include an inwardly protruding disc-shaped shelf in lieu of separate ground disc 49 without departing from the spirit of the present invention.

A pair of insulating washers 57-1 and 57-2 are disposed in direct contact against the opposing flattened surfaces of metallic ground disc 49. Insulating washers 57 are preferably constructed of any suitable thin film insulating material, such as polyimide (PI) material.

Inner Conductor 15

As seen most clearly in FIG. 2, an inner, or center, conductor 15 is longitudinally disposed within central cavity 27 and extends in a coaxial relationship relative to outer conductor 13, inner conductor 15 serving to transmit the desired communication signal for device 11. Inner conductor 15 is preferably constructed of a highly conductive material that is suitable for transmitting electrical signals, such as a high strength copper alloy with a suitable conductive finish, and is conductively isolated from outer conductor 13 by one or more one dielectric sleeves 59, as will be described further below.

Unless isolation is required, as will be described in detail below, inner conductor 15 is preferably constructed as a unitary member that includes an inner section 61 and opposing, co-linear outer sections 63 and 65. It should be noted that the outer diameter of inner section 61 is slightly greater than the outer diameter of adjacent outer sections 63 and 65. In addition, inner section 61 of inner conductor 15 is in near alignment with inner section 21 of outer conductor 13. As will be described further in detail below, the relationship between the variable inner diameter of outer conductor 13, the variable outer diameter of inner conductor 15 and the design and properties of dielectric sleeves 59 provide device 11 with its high performance wide band capabilities.

Distal end 63-1 of outer section 63 is in the form of a female socket that is dimensioned to fittingly receive a corresponding male pin. Similarly, distal end 65-1 of outer section 65 is in the form of a reduced diameter male pin that tapers slightly inward at its tip to facilitate insertion into a complementary female connector. However, it should be noted that the distal ends 63-1 and 65-1 are not limited to the aforementioned connector types. Rather, it is to be understood that distal ends 63-1 and 65-1 of outer sections 63 and 65, respectively, could be constructed in alternative configurations without departing from the spirit of the present invention.

Accordingly, it is to be understood that distal end 23-1 of outer conductor 13 and distal end 63-1 of inner conductor 15 together form a first coaxial connector interface 67. Similarly, it is to be understood that distal end 25-1 of outer conductor 13 and distal end 65-1 of inner conductor 13 together form a second coaxial connector interface 69. As will be described further in detail below, first and second coaxial electric devices can be releasably joined together by coupling a connector interface similar to first coaxial connector interface 67 on one of said devices with a connector interface similar to second coaxial connector interface 69 on the other of said devices, thereby establishing a conductive path therebetween.

As can be seen in FIG. 2, inner section 61 is shaped to define a transverse, or radial, tap hole 71 at its approximate midpoint. As will be described further below, hole 71 is internally threaded and appropriately dimensioned to threadingly receive one end of tap conductor 17 and thereby serve as the region of conductive contact between tap conductor 17 and inner conductor 15.

In the present invention, a center dielectric sleeve, or insulator, 59-1 is axially mounted onto, and extends slightly beyond the ends of inner section 61 of inner conductor 15, center dielectric sleeve 59-1 being dimensioned to substantially fill in the portion of central cavity 27 between intermediary section 21 of outer conductor 13 and inner conductor 15. Similarly, opposing outer dielectric sleeves, or insulators, 59-2 and 59-3 are axially mounted onto outer sections 63 and 65, respectively, and are dimensioned to substantially fill in the portion of central cavity 27 between inner conductor 15 and end sections 23 and 25, respectively.

Together, insulators 59-1 thru 59-3 serve to both mechanically support inner conductor 15 and electrically insulate inner conductor 15 from outer conductor 13, insulators 59 being constructed of any conventional insulated material, such any well known fluorocarbon solid (e.g., a Teflon® polytetrafluoroethylene (PTFE)). In addition, it is to be understood that at least a portion of the length of insulators 59 could be formed of an air dielectric, as will be described further in detail below.

It should be noted that the present invention is not limited to the use of three separable insulators 59. Rather, it is to be understood that the number of insulators 59 could be increased or decreased without departing from the spirit of the present invention.

Tap Conductor 17

As noted above, device 11 is provided with a tap, or shunt, conductor 17 to, among other things, divert potentially harmful, transient voltages (e.g., of the type generated from lightning strikes) away from inner conductor 15. To assist in the transmission of signals, tap conductor 17 is preferably constructed out of a highly conductive material, such as a copper, brass or a combination thereof.

Tap conductor 17 is represented herein as a straight, unitary member of constant cross-section along the majority of its length that includes a narrow, externally threaded first end 73 and a second end 75 that is generally in the form of a socket.

Externally threaded first end 73 is designed to screwed into internally threaded tap hole 71, thereby mechanically and conductively coupling tap conductor 17 to inner conductor 15. With first end 73 connected to inner conductor 15, the remainder of tap conductor 17 protrudes orthogonally away from inner conductor 15, projects through a fitted aperture in insulator 59-1 and extends co-axially through auxiliary cavity 46 in a spaced apart relationship relative to tap housing 41.

Second end 75 is dimensioned to fittingly receive the enlarged head 77-1 of a shoulder screw 77, the function of shoulder screw 77 to become apparent below. Although shoulder screw 77 and tap conductor 17 are shown herein as separate components that are mechanically and conductively coupled together, it is to be understood that should shoulder screw 77 could be integrally formed onto second end 75 of tap conductor 17 without departing from the spirit of the present invention.

Threaded distal end 77-2 of shoulder screw 77 is dimensioned to protrude through center hole 51 in ground disc 49 with significant clearance. In addition, threaded distal end 77-2 of shoulder screw protrudes through opposing insulating washers 57 that are mounted on opposing surfaces of ground disc 49. A metal washer 79 is axially mounted onto distal end 77-2 and is disposed directly between enlarged head 77-1 of shoulder screw 77 and insulating washer 57-1. In turn, a spanner nut 81 is threadingly mounted onto distal end 77-2 of shoulder screw 77 against exposed surface of insulator 59-2. Although not shown herein, spanner nut 81 could be shaped to include a pair of off-center holes which can be engaged by a spanner wrench in order to tighten spanner nut 81 on shoulder screw 77. As spanner nut 81 is tightened, metal washer 79, insulators 59, ground disc 49 and nut 81 are compressed firmly together in stacked, coaxial relationship. The area in which metal washer 79 and spanner nut 81 overlap ground disc 49, as well as the separation of insulated washers 57, together create a capacitance that is used to define the band pass characteristics of the RF through transmission line. Specifically, the aforementioned capacitance effectively causes tap conductor 17 to act as a quarter wave stub or grounded inductor. In addition, the aforementioned capacitance provides attenuation of certain frequencies on the through transmission line that are to be treated by voltage suppression and filtering components in attachment 19.

It should be noted that the present invention is not limited to a coaxial arrangement of nut 81, washer 79, insulators 59 and ground disc 49. Rather, the aforementioned elements could be alternatively arranged (e.g., in a radial implementation) without departing from the spirit of the present invention.

Modular Protective and Filtering Attachment 19

As noted briefly above, device 11 includes a modular protective and filtering attachment 19 that is removably mounted onto widened second end 45 of tap housing 41 and is conductively connected to tap conductor 17. As will be described further below, attachment 19 provides device 11 with, inter alia, voltage suppression and filtering capabilities and can be replaced and/or repaired, as needed, to renew or modify the performance characteristics of device 11.

Figure 3A:
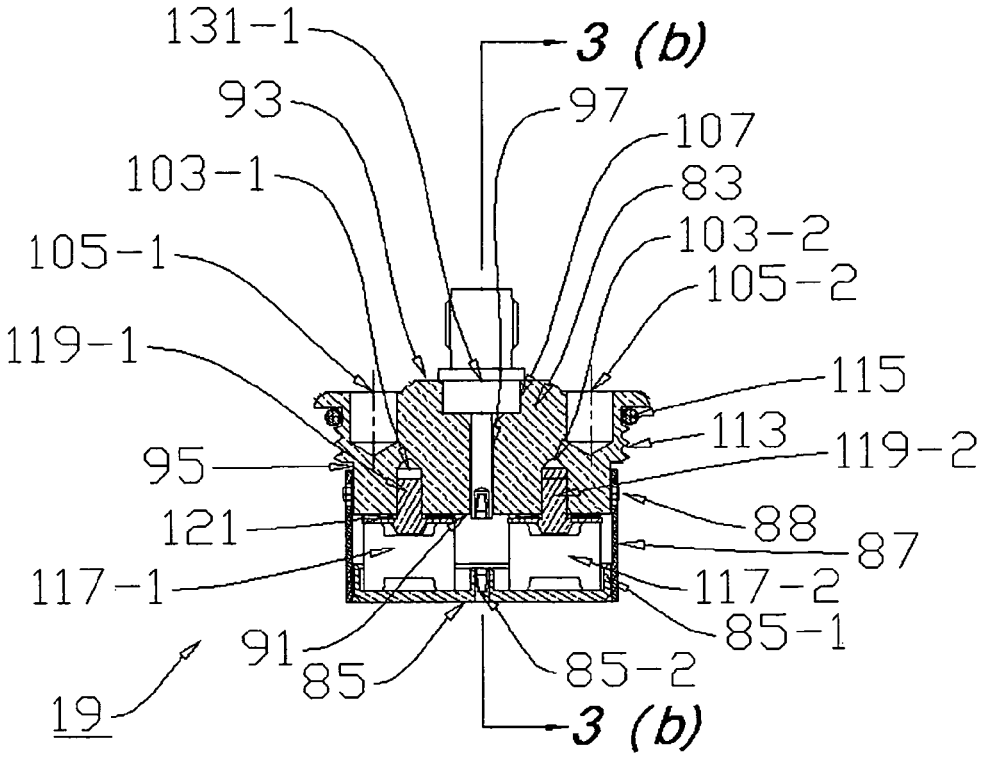
FIG. 3(*a*) is an enlarged section view of the protective and filtering attachment shown in FIG. 2.
Figure 3B:
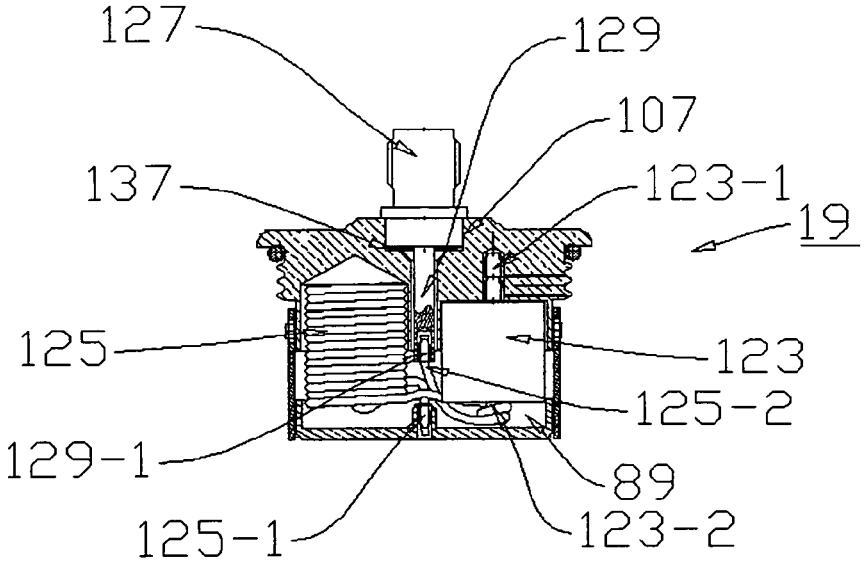

As seen most clearly in FIGS. 3(*a*) and 3(*b*), modular attachment 19 comprises a conductive end cap 83 and a metal contact 85 that are joined together in a spaced apart relationship by an insulator 87 that is wrapped around the periphery of at least a portion of cap 83 and contact 85.

Metal contact 85 is generally in the form of a flattened circular plate, or disc, that is constructed of a rigid, durable and highly conductive metallic material, such as brass. An integral upturned rim 85-1 is formed along the periphery of contact 85 and has a roughened outer surface. In addition, a cylindrical, upwardly projecting socket 85-2 is integrally formed on the top surface of contact 85 at its approximate center, socket 85-2 being shaped to define a narrow wire receptacle.

Insulator 87 is represented herein as an annular dielectric band, or tube, that is preferably constructed of a thin wall glass fiber reinforced plastic. Insulator 87 is bonded to the roughened outer surface of rim 85-1 and, in addition, is secured to end cap 83 by pins 88 with a limited degree of axial tolerance. Together, end cap 83, contact 85 and insulator 87 define an enclosed cavity 89 that is dimensioned to receive, among other things, various voltage suppression and filtering components, as will be described further below.

Conductive end cap 83 is in the form of a generally solid, cylindrical plug that is constructed of a rigid, durable and highly conductive metallic material, such as brass. As can be seen, end cap 83 includes a generally flat inner surface 91, a generally flat outer surface 93 and a rounded, continuous side surface 95. A central circular bore 97 extends longitudinally through the entirety of end cap 83 (i.e., from inner surface 91 to outer surface 93), the inclusion of bore 97 to become apparent below.

Figure 4:
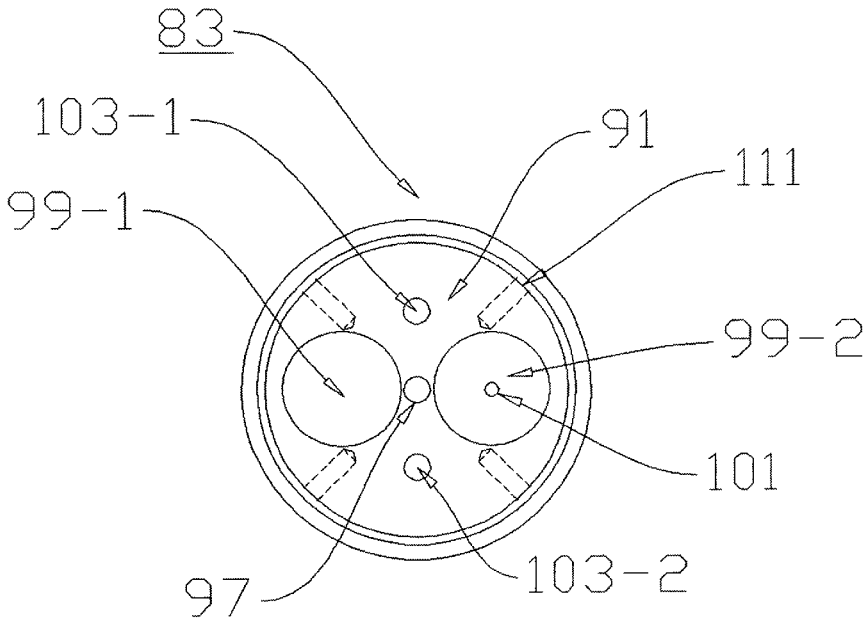
FIG. 4 is a bottom view of the end cap shown in FIG. 3(*b*)

As seen most clearly in FIG. 4, a pair of enlarged, circular holes 99-1 and 99-2 are partially recessed into inner surface 91 of conductive end cap 83, each hole 99 being dimensioned to receive a particular voltage suppression component, as will be described further below. It should be noted that hole 99-2 is a counterbore of smaller hole 101, the function of hole 101 to become apparent below.

In addition, a pair of small, opposing circular holes 103-1 and 103-2 are partially recessed into inner surface 91 of conductive end cap 83, holes 103 being spaced equidistantly apart from holes 99. As will be described further below, holes 103 are provided to assist in holding additional voltage suppression components within cavity 89.

Referring back to FIG. 3(*a*), a pair of generally circular spanner holes 105-1 and 105-2 is formed into outer surface 93 of end cap 83, holes 105 being dimensioned to receive corresponding pins of a spanner wrench (not shown) and thereby facilitate screwing attachment 19 into tap housing 41. In addition, an enlarged, central counterbore 107 is formed into outer surface 93 of end cap 83, counterbore 107 being coaxially aligned with longitudinal bore 97. As will be described further below, counterbore 107 is fittingly dimensioned to receive at least a portion of an auxiliary connector, thereby allowing for auxiliary power and/or signal coupling to the through RF path, which is highly desirable.

Side surface 95 is shaped to include define four, equidistantly spaced, inwardly projecting, radial holes 111. As can be appreciated, pins 88 are designed to penetrate through dielectric insulator 87 and into fitted insertion into corresponding holes 111 in order to secure insulator 87 around end cap 83 and thereby render attachment 19 a unitary, modular member.

Side surface 95 is additionally shaped to include external threading 113 that is designed to engage internal threading 47 on widened second end 45 of tap housing 41, as shown in FIG. 2. Accordingly, it is to be understood that attachment 19 is designed to be conductively coupled to outer conductor 13 by screwing attachment 19 into mechanical engagement with widened end 45 of tap housing 41 (e.g., using a spanner wrench with holes 105). In order to create a tight seal when attachment 19 is coupled to outer conductor 13, an O-ring gasket 115 is preferably retained in a thread undercut in side surface 95 of end cap 83.

It should be noted that as attachment 19 is screwed into widened end 45, metal contact 85 is drawn into direct contact against the exposed surface of nut 81. As a result, with attachment 19 secured to tap housing 41 in the manner set forth above, tap conductor 17 is conductively coupled to metal contact 85 through shoulder screw 77 and nut 81.

It should also be noted that attachment 19 is not limited to mechanical connection with tap housing 41 by threaded engagement. Rather, it is to be understood that attachment 19 could be mechanically and conductively connected with tap housing 41 by any suitable securement means, such as through a press-fit contact, without departing from the spirit of the present invention.

As noted above, attachment 19 is preferably provided with voltage suppression capabilities. Specifically, as shown in FIG. 3(*a*), a pair of gas discharge tubes 117-1 and 117-2 is disposed in cavity 89 in axial alignment with holes 103-1 and 103-2, respectively. A pair of guide pins 119-1 and 119-2 are provided to retain gas discharge tubes 117-1 and 117-2, respectively, in place within cavity 89, with one end of each pin 119 fittingly engaging a dimple integrally formed into each gas discharge tube 117 and the opposite end of each pin 119 fittingly penetrating into its corresponding hole 103. Preferably, a metal crescent or wave spring 121 is disposed between the head of each pin 119 and end cap 83. In this manner, each spring 121 urges its corresponding gas discharge tube 117 (via pin 119) firmly into conductive contact against contact 85 which, in turn, can provide a resilient force that urges contact 85 against spanner nut 81.

As such, it is to be understood that each gas discharge tube 117 is conductively connected to contact 85 at one end and end cap 83 at its opposite end. In use, gas discharge tubes 117 operate as voltage limiting components that are capable of suppressing high current levels. Due to their independent coupling between end cap 83 and contact 85, gas discharge tubes 117-1 and 117-2 are effectively connected in parallel. As a result, gas discharge tubes 117-1 and 117-2 provide voltage suppression redundancy (i.e., continued protection even if one gas discharge tube 117 fails), thereby extending the operational lifetime of attachment 19, which is highly desirable.

A diode 123 and an inductor 125 are additionally disposed in cavity 89 to further assist in providing transient voltage protection to device 11. In use, diode 123 is designed to function as a high voltage suppression component. Inductor 125 is provided to limit the initial pulse current received by diode 123 since gas discharge tubes 117 are inherently designed to experience a delayed response to treating transient voltages.

As seen most clearly in FIG. 3(*b*), diode 123 is disposed in axial alignment within hole 99-2 and, as such, is securely retained within cavity 89. A first terminal, or wire lead, 123-1 for diode 123 is fittingly inserted into circular hole 101. As such, terminal 123-1 of diode 123 is effectively grounded through conductive connection with end cap 83 (which, in turn, is conductively coupled to grounded outer conductor 13). It is to be understood that first terminal 123-1 is conductively connected to end cap 83 by any suitable means, such as by integrating a spring socket contact into hole 101 or using a set screw to urge first terminal 123-1 into contact with the wall in end cap 83 that immediately defines hole 101.

Inductor 125 is preferably formed from a length of magnet wire that is wound in a generally cylindrical configuration and, in turn, disposed in axial alignment within hole 99-1 to retain inductor 125 securely within cavity 89. To insulate inductor 125 from end cap 83, a dielectric material, such as tape, is preferably wrapped around the wound magnetic wire. A first terminal, or wire lead, 125-1 for inductor 125 is fittingly inserted into center socket 85-2, thereby establishing a conductive path between inductor 125 and contact 85 (which, in turn, is conductively connected to tap conductor 17). A second terminal, or wire lead, 125-2 for inductor 125 is conductively connected (e.g., through wrapping and/or soldering) to second terminal 123-2 for diode 123 and then, in turn, connected to pin end 129-1, both of leads 125-2 and 123-2 preferably being properly insulated from contact 85.

It should be noted that attachment 19 is not limited to the use of a pair of gas discharge tubes 117, diode 123 and inductor 125 to provide device 11 with transient high voltage protection. Rather, it is to be understood that alternative sets of voltage suppression components (e.g., four parallel gas discharge tubes) could be utilized in place thereof without departing from the spirit of the present invention.

In the present embodiment, attachment 19 is also preferably provided with power and communication signal filtering capabilities. Specifically, attachment 19 additionally includes an auxiliary connector 127 that allows for external power and/or signal coupling to the through RF path.

Figure 5:
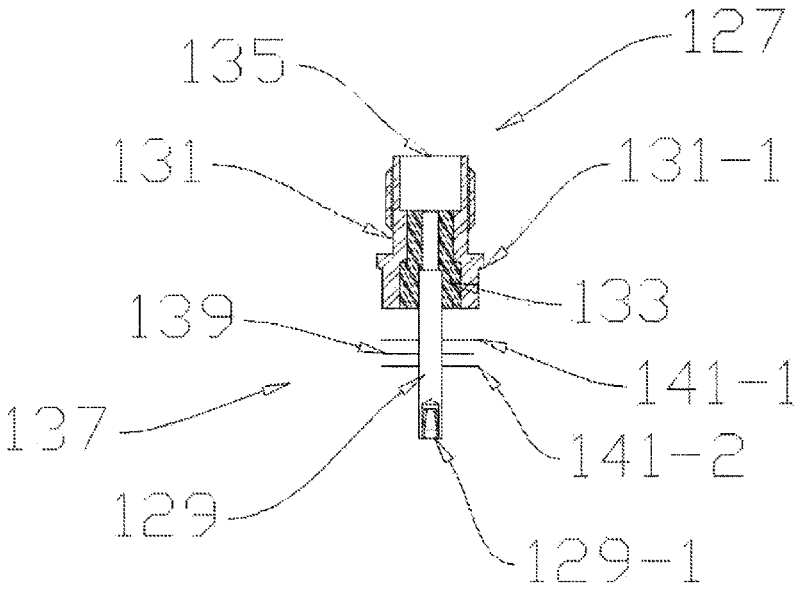
FIG. 5 is a partially exploded, section view of the auxiliary connector and filter shown in FIG. 3(*b*)

As seen most clearly in FIG. 5, auxiliary connector 127 is in the form of a coaxial power and signal connector that includes an elongated, conductive center pin 129 and a coaxial outer socket, or shell, 131 that are mechanically and conductively separated apart by an annular insulated sleeve 133. Together, pin 129 and outer socket 131 form a female-type connector interface 135 at their distal ends.

It should be noted that auxiliary connector 127 need not be limited to a coaxial power and signal connector with a female-type connector interface. Rather, it is to be understood that alternative types of connectors with different connector interfaces could be used for attachment 19 without departing from the spirit of the present invention. In fact, it is to be understood that attachment 19 could even be constructed without any auxiliary connection means.

Outer socket 131 is generally cylindrical in shape and is dimensioned to be press fit into counterbore 107 in end cap 83 so that center pin 129 coaxially protrudes through narrow longitudinal bore 97, as shown in FIG. 3(*a*). An outwardly protruding flange 131-1 is formed on outer socket 131 that is dimensioned to abut against outer surface 93 and thereby limit insertion of auxiliary connector 127 into counterbore 107. As such, auxiliary connector interface 135 is rendered externally accessible for connection to additional electric devices, as will be described further below.

Internal end 129-1 of center pin 129 is preferably in the form of a socket contact that is adapted to fittingly receive a conductive lead from either of terminals 123-2 and 123-5, as shown in FIG. 3(*b*). In this manner, auxiliary connector 127 is conductively coupled to both diode 123 and inductor 125.

As seen most clearly in FIG. 5, a filter 137 is axially mounted on center pin 129 of auxiliary connector 127 to assist in providing attachment 19 with signal filtering capabilities. Filter 137 comprises a disc-shaped conductive foil member 139 that is preferably constructed as thin as can be practically manufactured and handled. Foil member 139 is preferably mounted on center pin 129 in conductive connection therewith (e.g., by radial contact or solder).

Foil member 139 is sandwiched between a pair of dielectric washers 141-1 and 141-2 (or, in the alternative, foil member 139 is effectively created by plating the inner surface of either washer 141 with a foil-type material). As can be appreciated, each dielectric washer 141 is preferably dimensioned and/or constructed of a compression resistant material that allows for both direct contact axial mounting on center pin 129 as well as fitted insertion within counterbore 107. Together, foil member 139 and washers 141 are tightly disposed within counterbore 107 and thus are firmly wedged between outer shell 131 of auxiliary connector 127 and end cap 83, the outer diameter of foil member 139 being less than the outer diameter of washers 141 so as to provide a region of clearance between foil member 139 and end cap 83.

With foil member 139 and washers 141 firmly compressed between outer shell 131 of auxiliary connector 127 and end cap 83, a capacitance is created between foil member 139, end cap 83 and outer shell 131 of auxiliary connector 127, the capacitance value being controlled by, inter alia, the overlap of foil member 139, end cap 83 and outer socket 131 as well as the thickness and material properties of dielectric washers 141. As can be appreciated, this capacitance can create a low pass effect for the electrical energy passing through auxiliary connector 127. In this regard, by changing the capacitance value (i.e., by modifying the capacitance controlling factors set forth above), a low pass filter with a cutoff frequency can be created that is used to attenuate energy at undesired frequencies (e.g., prevent RF signals from leaking out of device 11 through auxiliary connector 127 during the injection/retrieval of DC power).

In order for this capacitance to not have appreciable effect on the lower frequency signal bands, the frequency of the through RF path would normally have to be more than 10 times the frequency of any signal that needs to pass beyond auxiliary connector 127. Provided that the through RF path and signal bands are sufficiently separated, it is then possible for multiple RF bands to be in use in both the RF through path as well as in the signal bands, which is highly desirable.

Operation of Device 11

Figure 6:
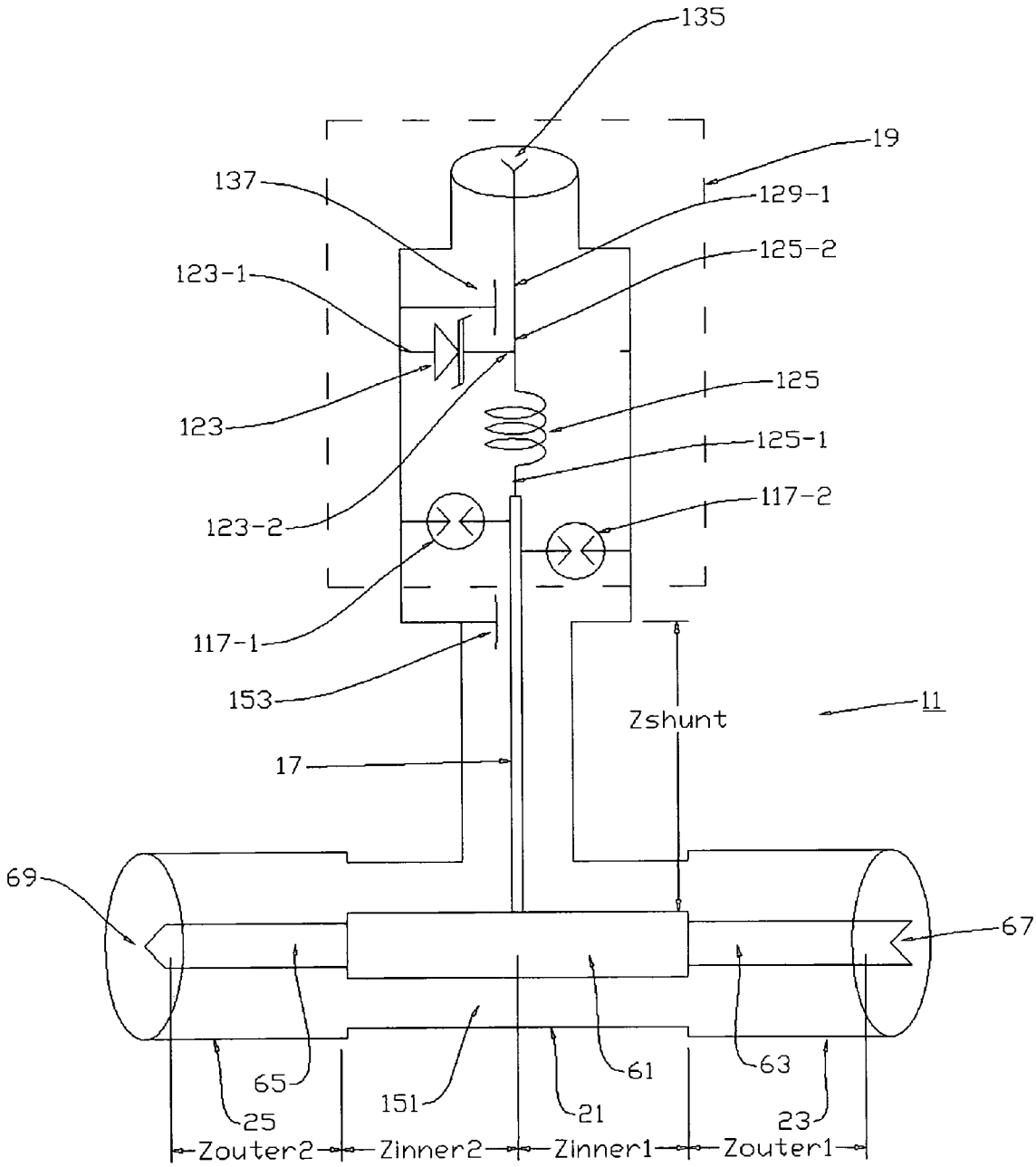
FIG. 6 is a simplified schematic representation of the device shown in FIG. 1 that is useful in understanding its intended operation.

Referring now to FIG. 6, there is shown a simplified schematic representation of device 11 which is useful in understanding its operation. Specifically, as can be seen, the coaxial construction of device 11 serves to create a through RF path 151 that is designed to transmit high frequency signals of a designated range (preferably over 1 octave in bandwidth) between first and second coaxial connector interfaces 67 and 69.

Tap conductor 17 is conductively connected at one end to through RF path 151. In use, tap conductor 17 serves as an auxiliary path through which power and/or communication signals falling outside of the designated frequency range can be retrieved from or injected into through RF path 151. As noted above, external access to the auxiliary path is achieved via auxiliary connection interface 135.

As noted above, a capacitance is created between ground disc 49, washer 79 and nut 81, by operation of insulators 59, that functions as a capacitive bypass 153. In use, capacitive bypass 153 serves to block signals of certain frequencies, in most cases frequency bands above 400 MHz, from transmission along tap conductor 17 and instead directs said signals back to through RF path 151. When designed as a low pass filter, capacitive bypass 153 limits transmission along tap conductor 17 to (i) low frequency communication signals (e.g., control and/or modem signals), (ii) DC power signals, and (iii) transient voltages with lower frequency content (e.g., of the type typically associated with lightning strikes).

Gas discharge tubes 117-1 and 117-2 are connected in parallel between tap conductor 17 (via metal contact 85) and ground (via grounded end cap 83). Accordingly, gas discharge tubes 117 are designed to limit high voltages at the bypassed end of tap conductor 17 (i.e., voltages that are sent along tap conductor 17 past capacitive bypass 153). As noted briefly above, the redundant connection of multiple gas discharge tubes 117 provides device 11 with a significantly longer pulse life than a similarly constructed device that includes only a single gas discharge tube, which is highly desirable.

Inductor 125 is effectively located along the auxiliary path beyond gas discharge tubes 117 (i.e., between gas discharge tubes 117 and auxiliary connector interface 135). As can be seen, terminal 125-1 of inductor 125 is conductively coupled to tap conductor 17 (via metal contact 85) and terminal 125-2 of inductor 125 is connected to terminal 123-2 of diode 123 (which is represented herein as a zener diode) and continues to pin end 129-1. In turn, terminal 123-1 of zener diode 123 is connected to ground (via grounded end cap 83).

In use, high transient voltages present along the auxiliary path are treated as part of a two-stage voltage suppression process. In the first stage, voltages are treated by zener diode 123 because gas discharge tubes 117 are inherently designed with a performance delay (which is acceptable since zener diode 123 provides better voltage suppression performance than gas discharge tubes 117). As such, zener diode 123 functions as a high voltage suppression component and treats the transient voltages. For protection, inductor 125 is provided to introduce an impedance that limits the pulse current that is received by zener diode 123. In turn, the excess pulse current (i.e., the current not received by zener diode 123) is treated by gas discharge tubes 117.

Filter 137 is provided at the end of the auxiliary path between terminal 129-1 and auxiliary connection interface 135. As noted above, filter 137, in conjunction with the series impedance of inductor 125 and the shunt impedance of diode 123, assists in further attenuating the RF signals on RF path 151 from continuing to connector 127.

Figure 7:
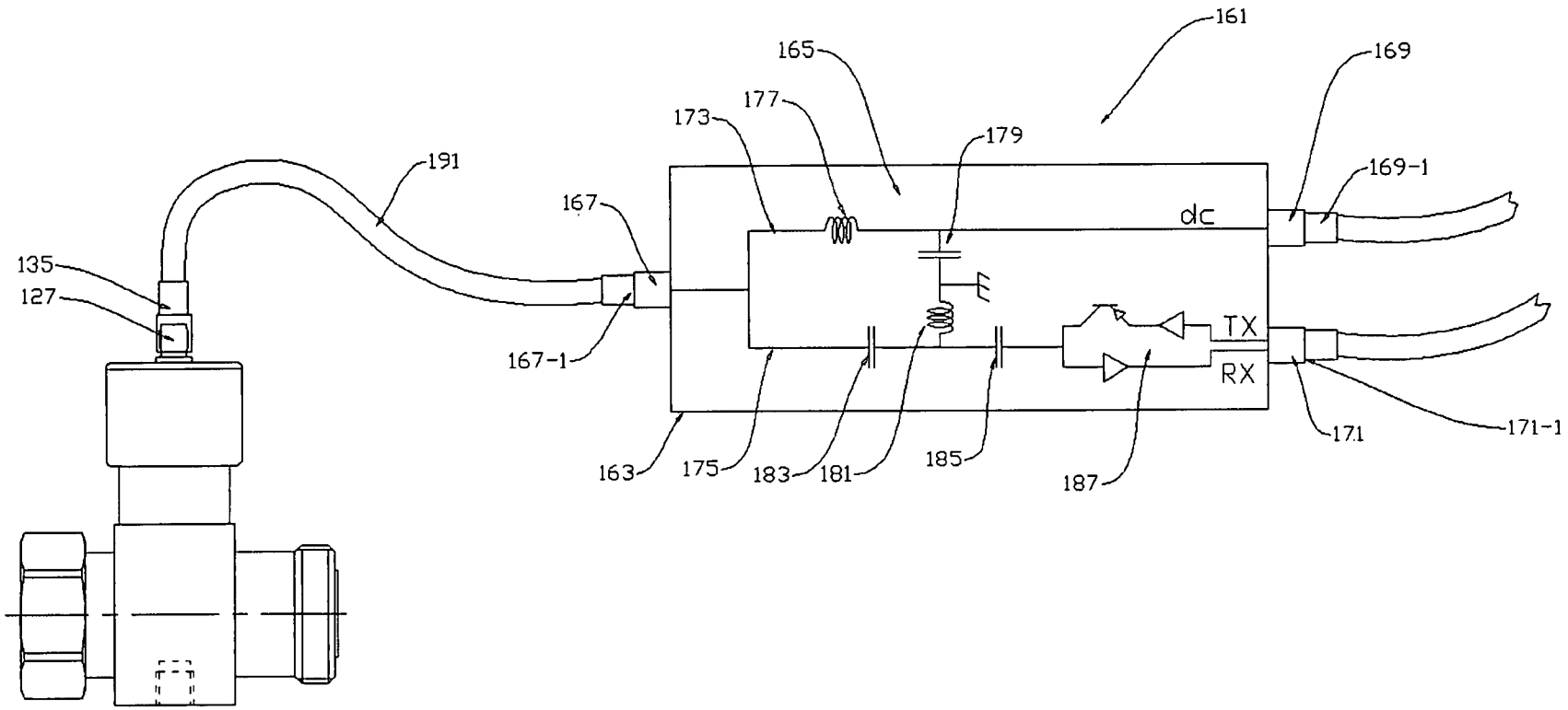
FIG. 7 is a fragmentary front view of a signal and power separation apparatus constructed according to the teachings of the present invention, the apparatus being shown broken away in part to reveal its internal circuitry, the apparatus additionally being shown connected to the auxiliary connector for the device shown in FIG. 1.

For example, referring now to FIG. 7, there is shown a signal and power separation apparatus 161 that is designed to be coupled to auxiliary connector 127 to facilitate further separation of both power and communication signals that are injected into and retrieved from inner conductor 15 of the through RF path.

Apparatus 161 comprises a protective housing 163, a signal separation circuit 165 disposed within housing 163, a combined signal/power connector 167 externally mounted on housing 163 in electrical connection with circuit 165, a power connector 169 externally mounted on housing 163 in electrical connection with circuit 165 and a communication connector 171 externally mounted on housing 163 in electrical connection with circuit 165.

As can be seen, circuit 165 comprises a DC power path 173 and an alternating current (AC) communication signal path 175. In the present invention, an inductor 177 and a capacitor 179 form DC power path 173. In addition, an inductor 181 a pair of capacitors 183 and 185 and a transmit receive modem 187 form communication signal path 175. However, it is to be understood that DC power path 173 and communication signal path 175 are not limited to any particular design and/or arrangement of components.

In use, a cable 191 is connected at its ends to auxiliary connection interface 135 and interface 167-1 for combined power/signal connector 167. DC power path 173 of circuit 165 is then responsible for separating the DC power component of the signal received by connector 167 and, in turn, passing said component to power connector 169. As such, a back end device (not shown) connected to interface 169-1 of connector can be powered by the DC power component separated from inner conductor 15 of the RF transmission line.

Similarly, communication signal path 175 of circuit 165 is responsible for separating the communication signal component of the signal received by connector 167 and, in turn, passing said component to communication signal connector 171. As such, a back end device (not shown) can receive communication signals (e.g., control signals or modem signals) by connecting to interface 171-1 of connector 171.

It is to be understood that modem 187 is preferably provided in order to convert (i) lower frequency signals on the through RF transmission path to a standard industry communication scheme, such as an on/off shift keying signal (OOSK), or (ii) amplitude modulated bands to an industry standard digital signal, such as RS485. The digital signal could then be made available on communication interface 171-1.

Although connectors 169 and 171 are shown separately, it is to be understood that a single multi-pin connector could be used in place thereof without departing from the spirit of the present invention.

Figure 8:
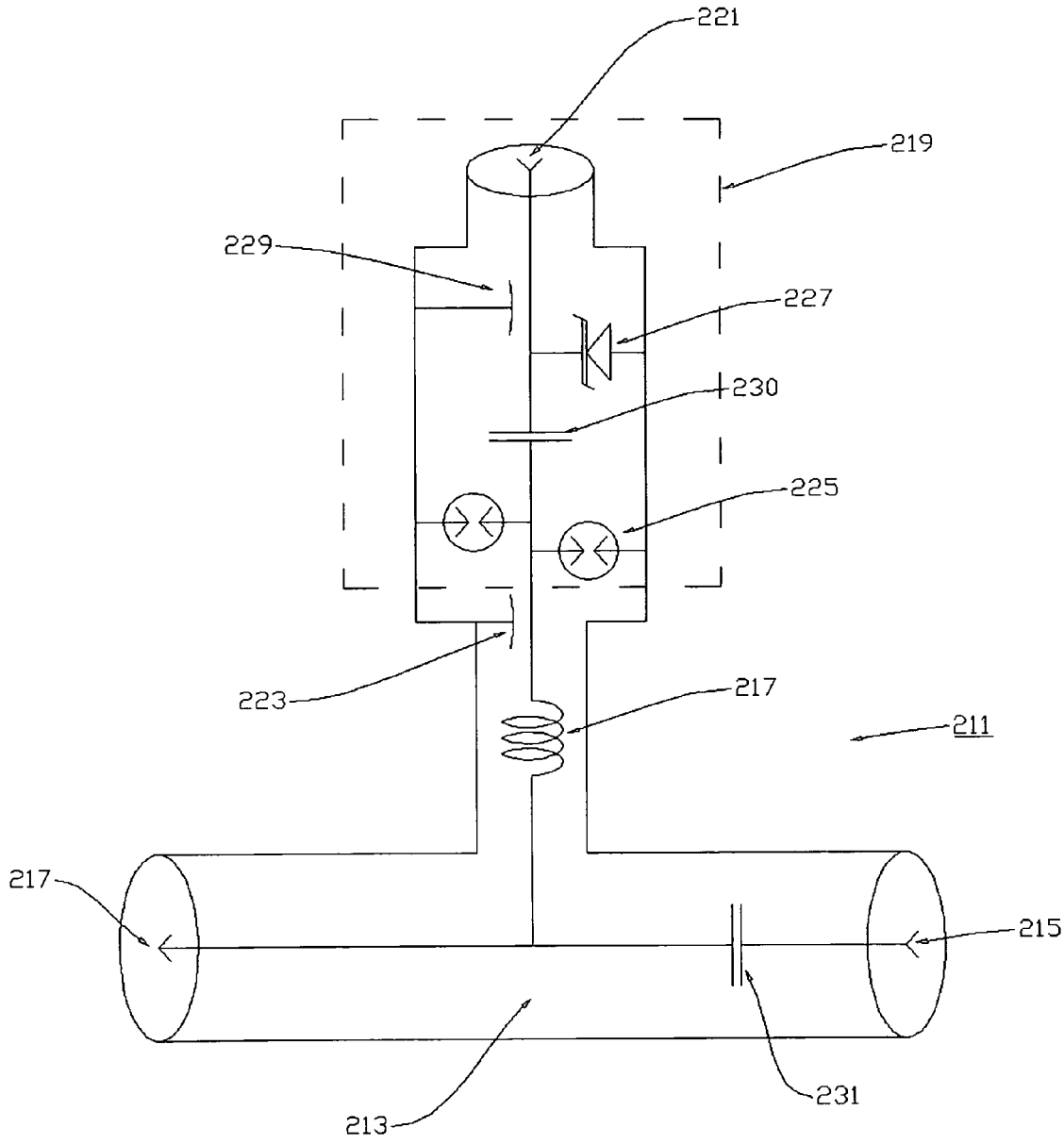
FIG. 8 is a simplified schematic representation of a modified version of the device shown in FIG. 6.

It is to be understood that numerous variations could be made to device 11 without departing from the spirit of the present invention. For example, referring now to FIG. 8, there is shown a simplified schematic representation of a modified version of device 11 that is designed to block certain DC power and communication signals from transmission along the through RF path and thereby limit signal transmission along the RF through path to signals within the desired frequency band, the modified device being identified generally by reference numeral 211.

Device 211 is similar to device 11 in that device 211 has a coaxial construction that creates a through RF path 213 designed to transmit high frequency signals of a designated range (preferably over 1 octave in bandwidth) from a first coaxial connector interface 215 to a second coaxial connector interface 217.

Device 211 additionally includes a tap conductor 217 conductively connected at one end to through RF path 213 that serves an auxiliary path through which power and/or signals falling outside of the designated frequency range can be externally retrieved from or injected into through RF path 213 via an auxiliary connection interface 221. Furthermore, the auxiliary signal path is similarly provided with a capacitive bypass 223, a pair of gas discharge tubes 225, a suppression zener 227 and a foil-based filter 229.

Device 211 differs from device 11 in that device 211 utilizes the impedance of a capacitor 230 (rather than an inductor) to limit the pulse current that is received by zener diode 227. As can be appreciated, capacitor 230 can be used in place of an inductor since device 211 is not designed to pass DC power out connection interface 221. Rather, device 211 is only designed to externally pass communication signals through connection interface 221.

Device 211 also differs from device 11 in that device 211 is designed to interrupt the transmission of DC power along through RF path 213. Specifically, through RF path 213 includes a DC block, or isolator, 231 between connector interface 215 and tap conductor 217. DC power (or, if the capacitance is low enough, the lower frequency AC signals present on the RF transmission line) cannot pass through device 11. That is, AC signals can pass through connection interface 221 but are permitted to travel in only direction along through RF path 213 (i.e., to connector interface 217 but not similarly to connector interface 215).

Figure 9:
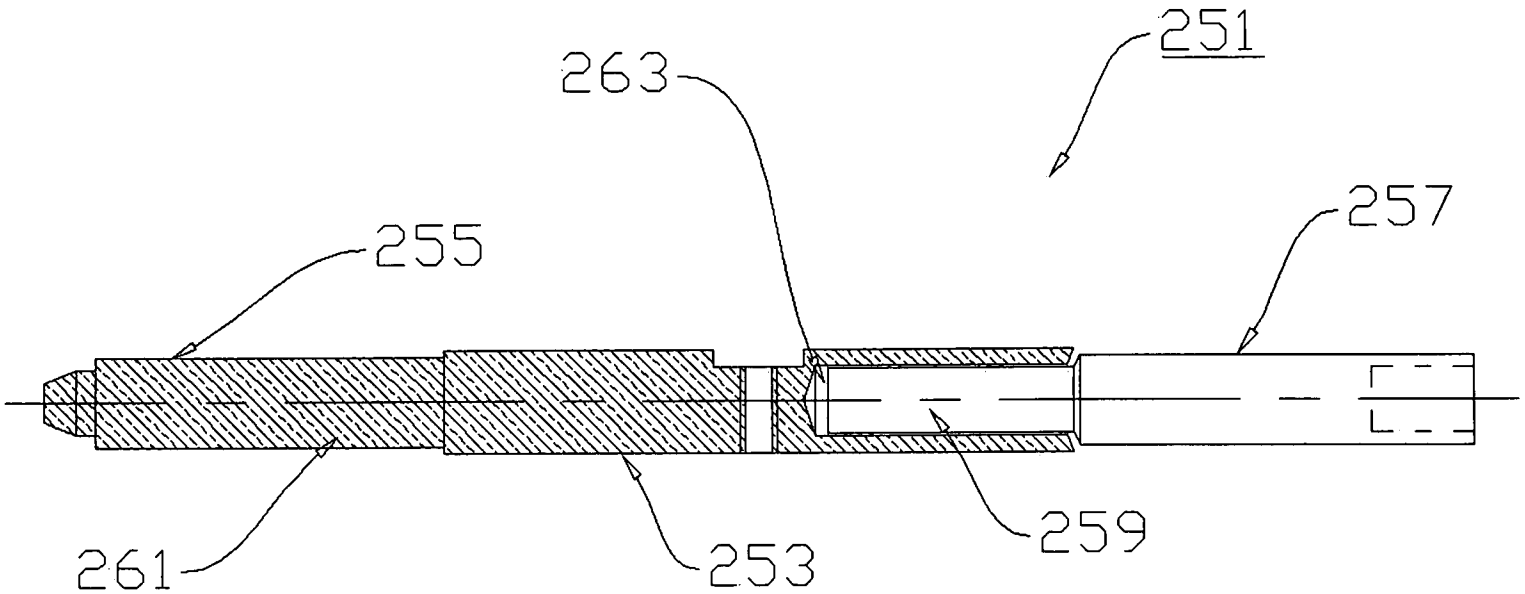
FIG. 9 is an enlarged, partial section view of a modification to the inner conductor shown in FIG. 2 that is able to achieve DC isolation capabilities.

DC isolation along RF through path 213 can be achieved by using an inner conductor with DC isolation capabilities. For example, referring now to FIG. 9, there is shown an inner conductor with DC isolation capabilities, the inner conductor being identified generally by reference numeral 251. As can be seen, inner conductor 251 is similar in design to inner conductor 15 in that inner conductor 251 includes an inner section 253 of increased outer diameter and opposing, co-linear outer sections 255 and 257 of reduced outer diameter.

Inner conductor 251 differs from inner conductor 15 in that inner conductor 251 comprises first and second separable conductive segments 259 and 261 that are co-axially joined together in a telescoping relationship but that are conductively separated by a thin layer of dielectric material 263. As can be appreciated, the construction and material properties of dielectric material 263 prohibits DC power and/or low frequency communication signals from passing between segments 259 and 261 but, at the same time, allows high frequency RF bands (e.g., of the type that fall within the designated frequency band) to pass relatively unimpeded.

It should be noted that inner conductor 251 is not limited to the use of dielectric material 263 to provide DC blocking capabilities. Rather, it is to be understood that a capacitor, or flat area capacitive link, could be used in place thereof without departing from the spirit of the present invention.

As a principal feature of the present invention, it is to be understood that device 11 is able to achieve wide band RF pass performance by using a double compensated quarter wave stub. Referring now to FIGS. 2 and 6, double compensation is achieved in the present invention by manipulating quarter length sections of the transmission line.

Specifically, tap conductor 17 and the inside diameter configuration of tap housing 41 creates the shunt quarter wave stub, which is represented as $Z_{SHUNT}$ in FIG. 6. Double compensation of the quarter wave stub is achieved through the creation first and second pairs of quarter wavelength impedances that are arranged in series along the transmission line, the first and second pairs of impedances being symmetrically formed about tap conductor 17. As noted briefly above, the impedance of the transmission lines directly corresponds to the outer diameter of inner conductor 15 in relation to the inner diameter of outer conductor 13 as well as the dielectric material therebetween.

Accordingly, as shown in FIG. 6, the geometric relationship of inner section 61 of inner conductor 15 with respect to the inner diameter of grounded center section 21 creates a pair of equal impedances $Z_{inner1}$ and $Z_{inner2}$ that are symmetrically formed about tap conductor 17. In turn, the geometric relationship of outer sections 63 and 65 of inner conductor 15 with respect to sections 23 and 25, respectively, of grounded outer conductor 13 creates a pair of impedances $Z_{outer1}$ and $Z_{outer2}$ that are also symmetrically formed about tap conductor 17 (with impedances $Z_{inner1}$ and $Z_{outer1}$ arranged in series and impedances $Z_{inner2}$ and $Z_{outer2}$ arranged in series). Furthermore, it is to be understood that device 11 is preferably designed so that nominal impedance $Z_{nominal}$ is exhibited at connector interfaces 67 and 69.

As can be appreciated, device 11 exhibits wide band characteristics because, inter alia, (i) the outer diameter of inner section 61 is greater than the outer diameter of outer sections 63 and 65; and (ii) the inner diameter of center section 21 is less than inner diameter of sections 23 and 25. The particular impedance of the quarter wavelengths of transmission are selected to improve the RF performance of the through transmission line.

Most notably, minimized voltage standing wave ratio (VSWR), which is a measure of how well a device is matched to its intended characteristic impedance, or $Z_{nominal}$, can be achieved for device 11 when (i) the impedance of $Z_{inner1}$ and $Z_{inner2}$ is approximately 45-75% of the nominal line impedance $Z_{nominal}$ and (2) the impedance of $Z_{outer1}$ and $Z_{outer2}$ is approximately 75%-95% of the nominal line impedance $Z_{nominal}$.

As an example, for a transmission line with a nominal characteristic impedance, $Z_{nominal}$, of 50 ohms, device 11 exhibits minimal VSWR performance within an intended RF frequency range of 3:1 (high-to-low frequency) when (i) the impedance of $Z_{inner1}$ and $Z_{inner2}$ is approximately 31 ohms, (ii) the impedance of $Z_{outer1}$ and $Z_{outer2}$ is approximately 44 ohms, and (iii) the impedance of $Z_{shunt}$ is approximately 39 ohms. When using sleeves 59 constructed of PTFE, the aforementioned impedances can be achieved utilizing the following relative dimensions: (i) the inner diameter of inner section 21 is 2.12 times greater than the outer diameter inner section 61; (ii) the inner diameter of outer end sections 23 and 25 are 2.90 times greater than the outer diameter of outer sections 63 and 65; and (iii) the inner diameter of tap housing 41 is 2.55 times greater than the outer diameter of tap conductor 17.

As another example, for a transmission line with a nominal characteristic impedance, $Z_{nominal}$, of 50 ohms, device 11 exhibits minimal VSWR performance within an intended RF frequency range of 5:1 (high-to-low frequency) when (i) the impedance of $Z_{inner1}$ and $Z_{inner2}$ is approximately 30 ohms, (ii) the impedance of $Z_{outer1}$ and $Z_{outer2}$ is approximately 41 ohms, and (iii) the impedance of $Z_{shunt}$ is approximately 56 ohms. When using air as the dielectric in place of PTFE sleeves 59, the aforementioned impedances can be achieved utilizing the following relative dimensions: (i) the inner diameter of inner section 21 is 1.65 times greater than the outer diameter inner section 61; (ii) the inner diameter of outer end sections 23 and 25 is 1.98 times greater than the outer diameter of outer sections 63 and 65; and (iii) the inner diameter of tap housing 41 is 2.55 times greater than the outer diameter of tap conductor 17.

It should be noted that even further modifications could be made to device 11 without departing from the spirit of the present invention. Specifically, it should be noted that device 11 is not limited to the use of PTFE sleeves 59 to insulate inner conductor 15 from outer conductor 13. Rather, it is to be understood that alternative materials, such as air, could be used in place of PTFE sleeves 59 without compromising its performance characteristics.

Figure 10:
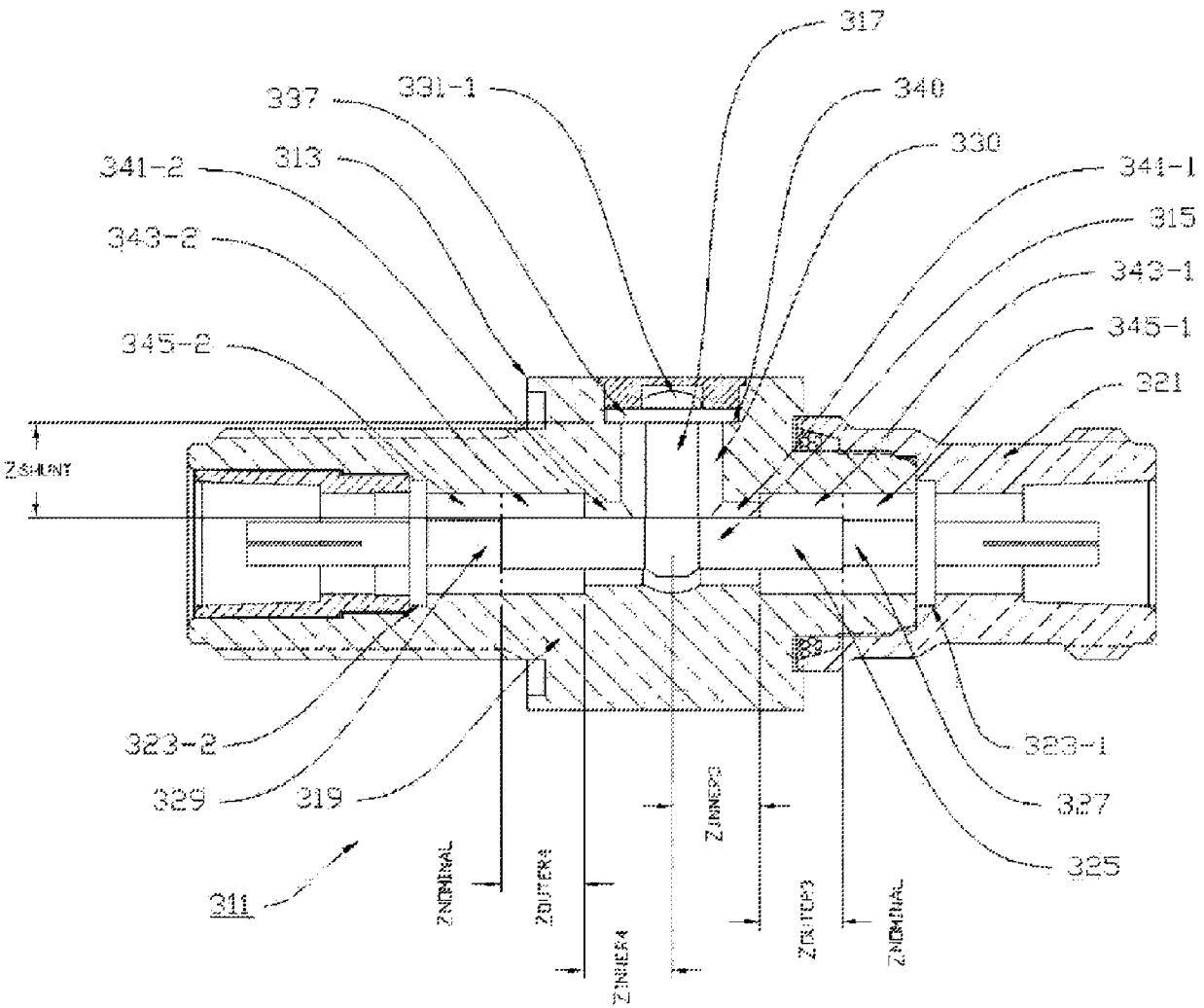
FIG. 10 is a partial section view of another embodiment of a device for transmitting electromagnetic signals of a desired frequency band, the device being constructed according to the teachings of the present invention.

Referring now to FIG. 10, there is shown another embodiment of a device for a radio frequency (RF) transmission line that is designed to transmit very high frequency wide band signals between a source and a load, the device being constructed according to the teachings of the present invention and represented generally by reference numeral 311.

As can be seen, device 311 is similar to device 11 in that device 311 comprises an outer conductor 313, an inner conductor 315 extending within outer conductor 313 and a tap conductor 317 conductively coupled to inner conductor 315 for diverting to ground selected signals carried by inner conductor 315.

Device 311 is also similar to device 11 in that elements of device 311 are configured to create a first pair of quarter wavelength impedances $Z_{inner3}$ and $Z_{outer3}$ that are arranged in series along the transmission line and a second pair of quarter wavelength impedances $Z_{inner4}$ and $Z_{outer4}$ that are arranged in series along the transmission line. As can be seen, the first pair of quarter wavelength impedances $Z_{inner3}$ and $Z_{outer3}$ and the second pair of quarter wavelength impedances $Z_{inner4}$ and $Z_{outer4}$ are symmetrically formed about tap conductor 317, with nominal impedance $Z_{nominal}$ extending outward on the transmission line beyond outer impedances $Z_{outer3}$ and $Z_{outer4}$. As a result of the creation of the symmetrical pair of series impedances about tap conductor 317, a double compensated quarter wave stub is effectively established that, in turn, enables device 311 to achieve wide band RF pass performance, which is highly desirable.

Outer conductor 313 is similar to outer conductor 13 in that outer conductor 313 formed as generally hollow cylindrical member that is cast, forged or otherwise constructed from a rigid, durable and highly conductive material, such as a copper alloy with a suitable conductive finish. In the present invention, outer conductor 313 comprises a base portion 319 and a connector end 321 that are secured together using complementary threadings. However, it is to be understood that outer conductor 313 is not limited to a two-piece construction.

Inner conductor 315 is similar in construction to inner conductor 15 in that inner conductor 315 extends in a coaxial relationship relative to outer conductor 313. However, in place of PTFE dielectric sleeves 59, device 311 relies primarily upon air to insulate inner and outer conductors 313 and 315. In order to hold inner conductor 315 fixed in place relative to outer conductor 313, a pair of opposing, thin dielectric washers 323-1 and 323-2 is axially mounted on inner conductor 313 that, in turn, fittingly engage the inner surface of outer conductor 313 for support. It should be noted that each washer 323 may include one or more transverse holes 324 to impedance regulation purposes.

Inner conductor 315 also is shaped to include an inner section 325 and opposing, co-linear outer sections 327 and 329, with the outer diameter of inner section 325 being slightly greater than the outer diameter of outer sections 327 and 329. As will be described further below, this variance in the outer diameter of inner conductor 315 assists in the creation of the double compensated quarter wave stub effect.

Figure 11:
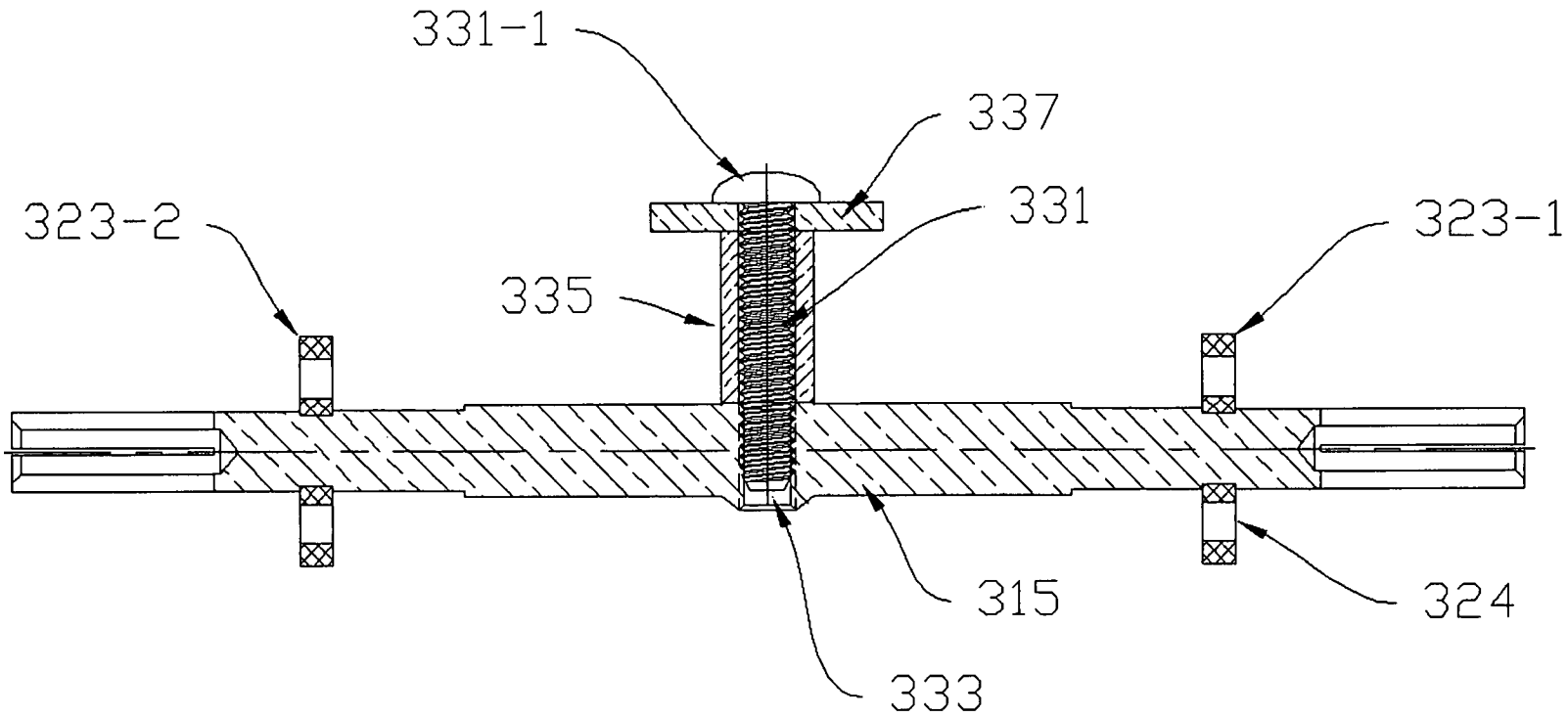
FIG. 11 is a section view of the inner conductor, tap conductor and dielectric washers shown in FIG. 10.

Tap conductor 317 is similar to tap conductor 17 in that tap conductor 317 is conductively coupled to inner conductor 313 and extends orthogonally out therefrom and into a transverse tap cavity 330 formed in outer conductor 313. As seen most clearly in FIG. 11, tap conductor 317 comprises an elongated screw 331 that is threadingly inserted into a corresponding cross-bore 333 formed in inner conductor 315. A conductive sleeve 335 is axially mounted over screw 331 and is urged into conductive contact with inner conductor 313 by a conductive washer 337 disposed between the distal end of sleeve 335 and the enlarged distal end 331-1 of screw 331. Referring back to FIG. 10, conductive washer 337 is dimensioned to rest in firm contact against a corresponding shelf 340 formed in outer conductor 313. In this manner, undesirable signals diverted away from inner conductor 315 by sleeve 335 of tap conductor 317 are ultimately grounded by outer conductor 313 via washer 337.

It should be noted that the particular variance in the inner diameter of outer conductor 313 along its length along with the particular variance of the outer diameter of inner conductor 315 along its length assists in the creation of the double compensated quarter wave stub effect. Specifically, the inner diameter of outer conductor 313 is reduced along sections of its length to define an inner pair of narrow air gaps 341-1 and 341-2 that are directly aligned with a portion of inner section 325, inner air gaps 341 being symmetrically formed about tap cavity 330 in an adjacent relationship relative thereto. In addition, the inner diameter of outer conductor 313 is increased along sections of its length to define an intermediary pair of widened air gaps 343-1 and 343-2 that are directly aligned with the remainder of inner section 325, intermediary air gaps 343 being symmetrically formed about inner air gaps 341 and tap cavity 330. Furthermore, the inner diameter of outer conductor 313 remains uniformly increased to washers 323 to define an outer pair of increasingly widened air gaps 345-1 and 345-2 that are directly aligned with portions of outer sections 327 and 329, respectively, outer air gaps 345 being symmetrically formed about tap cavity 330, inner air gaps 341 and intermediary air gaps 343.

Due to the variable configuration of the air gaps formed along the length of device 311, a compensated quarter wavelength stub is achieved. Specifically, the configuration of inner air gaps 341 creates a pair of impedances $Z_{inner3}$ and $Z_{inner4}$ that are symmetrically formed about tap conductor 317. In addition, the configuration of intermediary air gaps 343 creates a pair of impedances $Z_{outer3}$ and $Z_{outer4}$ that are also symmetrically formed about tap conductor 317 (with impedances $Z_{inner3}$ and $Z_{outer3}$ arranged in series and impedances $Z_{inner4}$ and $Z_{outer4}$ arranged in series). Furthermore, the configuration of outer air gaps 345 creates a pair of symmetrical nominal impedances $Z_{nominal}$ at its connective interfaces. As can be appreciated, device 311 exhibits excellent voltage standing wave ratio (VSWR) when (i) the impedance of $Z_{inner3}$ and $Z_{inner4}$ is approximately 50-75% of the nominal line impedance $Z_{nominal}$ and (2) the impedance of $Z_{outer3}$ and $Z_{outer4}$ is approximately 75%-90% of the nominal line impedance $Z_{nominal}$.

Notable Features of Device 11

As can be appreciated, device 11 has a number of notable features that provide significant functional advantages over RF transmission line devices that are well known in the art.

As a first feature of the present invention, the principal voltage suppression and filtering components for device 11 are housed, or compartmentalized, within unitary, separable attachment 19. Accordingly, if replacement of certain voltage suppression and filtering components is required (e.g., after a lightning strike), the user can simply unscrew attachment 19 and substitute it with a new or repaired attachment of identical design, thereby extending the operational life span of device 11, which is highly desirable.

As a second feature of the present invention, certain performance characteristics of device 11 are determined by the construction of attachment 19. Accordingly, a set of various attachments 19, each unique in its design and intended functionality, can be provided for threaded mounting on the distal end of tap housing 41 (since the remainder of device 11 is modular, or universal, in construction). In this capacity, the user can customize device 11 for a particular application by selecting the most appropriately constructed attachment 19, which is highly desirable.

As an example, if the user requires external DC power and control signal capabilities, attachment 19 is preferably selected. However, if the user does not require DC power and control signal capabilities, a modified attachment that is constructed without auxiliary connector 127 and filter 137 (i.e., with a substantially enclosed end cap 83) is preferably used in place thereof.

As another example, attachment 19 is preferably designed to inject and/or retrieve direct current (DC) signals at approximately 48 volts. However, it is to be understood that a modified attachment could be utilized in place thereof to receive alternating current (AC) signals (e.g., at approximately 50 Hz or 60 Hz). In this situation, if an external connection was desired for an AC signal without the need for a power connection, inductor 125 could be replaced with a capacitor of suitable value in order to pass the desired signal frequency band.

As a third feature of the present invention, device 11 comprises a filter 137 that is simple in its design, inexpensive to construct and can be easily installed by axially disposing foil member 139 and washers 141 on center pin 129 and, in turn, inserting auxiliary connector 127 (and its axially mounted elements) into counterbore 107 in a press-fit relationship. As can be appreciated, the integration of filter 137 into auxiliary connector 127 eliminates the need for a separate feed through capacitor to be integrated into the device circuitry, which is highly desirable because traditional feed through filters are rather fragile in nature, expensive to manufacture and cumbersome to install (e.g., through the soldering of filter terminals).

As a fourth feature of the present invention, elements of device 11 are configured to create a first pair of quarter wavelength impedances $Z_{inner1}$ and $Z_{outer1}$ that are arranged in series along the transmission line and a second pair of quarter wavelength impedances $Z_{inner2}$ and $Z_{outer2}$ that are arranged in series along the transmission line, with the first and second pairs of impedances being symmetrically formed about tap conductor 17. As a result of the creation of the symmetrical pair of series impedances about tap conductor 17, a double compensated quarter wave stub is effectively established that, in turn, enables device 11 to achieve wide band RF pass performance, which is highly desirable.

The embodiments of the present invention described above are intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A device for transmitting electromagnetic signals of a desired frequency band, the device comprising:
   (a) an outer conductor,
   (b) an inner conductor extending within the outer conductor, the inner and outer conductors being spaced apart and electrically insulated from one another,
   (c) a tap conductor for diverting transient voltages away from the inner conductor that fall outside the desired frequency band, the tap conductor comprising a first end and a second end, the first end of the tap conductor being conductively coupled to the inner conductor, the tap conductor being insulated from the outer conductor, and
   (d) a modular attachment mechanically and conductively coupled to the outer conductor, the attachment comprising a plurality of voltage suppression components for discharging transient voltages diverted by the tap conductor, each of the plurality of voltage suppression components being conductively coupled to the tap conductor and the outer conductor, wherein the attachment is constructed so as to be separable from the tap conductor and the outer conductor as a unitary member.

2. The device as claimed in claim 1 wherein the modular attachment comprises:
   (a) a conductive end cap conductively coupled to the outer conductor,
   (b) a metal contact spaced apart from the conductive end cap, the metal contact being conductively coupled to the tap conductor, and
   (c) an insulator connecting the conductive end cap and the metal contact to form the unitary member that is separable from the tap conductor and the outer conductor,
   (d) wherein the end cap, metal contact and insulator together define a cavity dimensioned to receive the plurality of voltage suppression components.

3. The device as claimed in claim 2 wherein each of the plurality of voltage suppression components is independently conductively coupled to both the end cap and the metal contact.

4. The device as claimed in claim 3 wherein the attachment further comprises an externally accessible auxiliary connector that is coupled to the tap conductor.

5. The device as claimed in claim 4 wherein the auxiliary connector comprises:

(a) a conductive outer shell, and (b) a conductive center pin extending within the outer shell, the center pin being insulated from the conductive outer shell, (c) wherein the outer shell of the auxiliary connector is mounted in the conductive end cap and the center pin is conductively coupled to the tap conductor.

6. The device as claimed in claim 5 wherein the modular attachment additionally comprises a filter for separating power and communication signals outside the desired frequency band from the inner conductor, the filter being fittingly disposed between the outer shell of the auxiliary connector and the conductive end cap.

7. The device as claimed in claim 6 wherein the filter comprises:

(a) a foil member conductively coupled to the conductive center pin, and (b) a pair of dielectric washers disposed on opposite surfaces of the foil member, the pair of dielectric washers insulating the foil member from both the outer shell of the auxiliary connector and the conductive end cap.

8. The device as claimed in claim 4 wherein the auxiliary connector is coupled to the tap conductor by a component that introduces impedance.

9. The device as claimed in claim 8 wherein the impedance introducing component that conductively couples the auxiliary connector to the tap conductor is an inductor.

10. The device as claimed in claim 8 wherein the impedance introducing component that couples the auxiliary connector to the tap conductor is a capacitor.

11. The device as claimed in claim 3 wherein the outer conductor comprises:

(a) one or more sections that define a central cavity through which the inner conductor extends, and (b) a tap housing connected to the one or more sections, the tap housing being shaped to define an auxiliary cavity through which the tap conductor extends, the central cavity and the auxiliary cavity being in communication with one another, (c) wherein the distal end of the tap housing is adapted to mechanically and conductively receive the modular attachment.

12. The device as claimed in claim 11 wherein the conductive end cap threadingly engages the distal end of the tap housing.

13. The device as claimed in claim 3 wherein the plurality of voltage suppression components includes a diode and at least one gas discharge tube.

14. The device as claimed in claim 3 wherein the plurality of voltage suppression component includes at least a pair of gas discharge tubes connected in parallel.

15. The device as claimed in claim 1 wherein the inner conductor has DC isolation capabilities.

16. An RF transmission line device for transmitting electromagnetic signals of a desired frequency band, the RF transmission line device having a nominal characteristic impedance, the RF transmission line device comprising:

(a) a grounded outer conductor, (b) an inner conductor extending within the outer conductor, the inner and outer conductors being electrically insulated from one another, and (c) a tap conductor for diverting transient voltages away from the inner conductor that fall outside the desired frequency band, the tap conductor comprising a first end and a second end, the first end of the tap conductor being conductively coupled to the inner conductor, (d) wherein the tap conductor functions as a quarter wave stub, the quarter wave stub being dually compensated through the creation of an inner pair of identical, below nominal quarter wavelength impedances formed about the tap conductor and an outer pair of identical, below nominal quarter wavelength impedances formed about the tap conductor.

17. The device as claimed in claim 16 wherein each of the inner pair of impedances is less in value than each of the outer pair of impedances.

18. The device as claimed in claim 17 wherein each of the inner pair of impedances is preferably in the range of 45-75% of the nominal characteristic impedance for the device.

19. The device as claimed in claim 18 wherein each of the outer pair of impedances is preferably in the range of 75-95% of the nominal characteristic impedance for the device.

20. The device as claimed in claim 19 wherein the first and second pairs of quarter wavelength impedances are created by varying at least one of the inner diameter of the outer conductor and the outer diameter of the inner conductor.

21. The device as claimed in claim 20 wherein the outer conductor comprises an intermediary section and first and second end sections that are adjacent, the inner diameter of the intermediary section being less than the inner diameter of an adjacent length of the first and second end sections.

22. The device as claimed in claim 21 wherein the inner conductor includes an inner section and a pair of adjacent outer sections, the outer diameter of the inner section being greater than the outer diameter of an adjacent length of the pair of outer sections.

23. The device as claimed in claim 16 wherein each of the inner pair of impedances is arranged in series with a corresponding impedance from the outer pair.

24. The device as claimed in claim 16 wherein the second end of the tap conductor is conductively coupled to the grounded outer conductor.

25. The device as claimed in claim 16 the second end of the tap conductor is capacitively coupled to the grounded outer conductor.

* * * * *